US005993599A

United States Patent [19]

Maginsky et al.

[11] Patent Number: 5,993,599

[45] Date of Patent: Nov. 30, 1999

[54] EASY ACCESS CHEMICAL CHAMBER WINDOW AND FRAME

[75] Inventors: Keith D. Maginsky, Ruffs Dale; Michael K. Pritts, Acme, both of Pa.

[73] Assignees: Sony Corporation, Tokyo, Japan; Sony Electronics, Inc., Park Ridge, N.J.

[21] Appl. No.: 09/076,873

[22] Filed: May 13, 1998

[51] Int. Cl.[6] ..... C23C 16/00; C23F 1/02

[52] U.S. Cl. ..... 156/345; 118/733

[58] Field of Search ..... 156/345; 438/745; 216/83; 118/733, DIG. 7

[56] References Cited

U.S. PATENT DOCUMENTS 4,676,261 6/1987 Blaul ..... 134/57 R 5,205,059 4/1993 Doll ..... 40/152

5,851,343 12/1998 Hsu et al. ..... 156/345

5,873,199 2/1999 Meunier et al. ..... 49/181

*Primary Examiner*—Robert Kunemund

*Assistant Examiner*—Matthew Anderson

*Attorney, Agent, or Firm*—Ronald P. Kananen; Rader, Fishman & Grauer

[57] ABSTRACT

A chemical etching chamber window apparatus includes a window, and a window housing harbored in a frame assembly, where the frame assembly includes grooves and a clamp for securing the window housing within the frame assembly, an opening for entry and removal of the window housing, a lower piece comprising a troth formed at an angle that allows fluid to flow toward the inside of the etching chamber, and weeping holes that allow fluid to drain into the etching chamber.

15 Claims, 4 Drawing Sheets

EASY ACCESS CHEMICAL CHAMBER WINDOW AND FRAME

BACKGROUND OF THE INVENTION

Chemical spray chambers such as etching chambers often include a window for viewing the spraying activities from the outside of the chamber without the danger of exposure to hazardous chemicals. The windows also allow for access to the mechanical equipment and product inside the chambers for repair or inspection. FIG. 1 shows the existing window for a typical etching spray chamber 106. The windows employ thick glass 101, surrounded by a metal frame 102 of about 20 inches by thirty inches. The frame 102 window 101 assembly is attached to the chamber 106 via ten threaded fasteners 104. Handles are incorporated into the metal frame 105 for handling of the assembly during removal from and attachment to the chamber.

Several problems exist with this design. The first is leaking of the hazardous chemicals from the chamber. Since the frame 102 window 101 assembly is attached by only ten points, the forced chemical spray originating inside the chamber easily leaks past the seal of the window between the fastening points. The acid then dissolves the metal frame 102, fasteners 104 and the acid drips on other equipment in the area resulting in frequent equipment failure. Secondary problems arise from use of the window. The thick glass 101 and metal frame 102 assembly is heavy. In addition the fasteners require twelve minutes to remove and re-install. A total of eighty eight windows are installed on some existing equipment. Simple removal and installation of all of the windows is thus a significant job.

It is therefore an object of the present invention to provide a chemical spray chamber window apparatus that makes it as difficult as possible for pressurized spray to break through the window seal, thus limiting potential leaks of harmful chemicals from the chamber. Assuming that some of the chemicals may leak at some point, it is a further object of the present invention to provide an apparatus that mitigates these potential leaks.

It is another object of the present invention to provide a chemical spray chamber window apparatus that is easily accessible. Elimination of threaded fasteners for access to the window in less than 15 seconds is part of this objective.

It is another object of the present invention to provide a chemical spray chamber window apparatus made of economical materials that will not be effected by acids and other dangerous materials sprayed in the chemical chamber. The design of the apparatus should be such that it is adaptable for existing spray chambers, and is reproducible by automated machining.

SUMMARY OF THE INVENTION

The above-described needs and others are met by the invention of a chemical etching chamber window apparatus that includes a window made of a transparent material, and a window housing, harbored in a frame assembly. The window housing is bonded to the edges of the window, and may have a handle situated on top of the housing. The frame assembly may have a groove located on inner side pieces and on an inner lower piece for securing the window housing. The frame assembly also may have a clamp for further securing the window housing within the frame assembly.

The window housing enters and is removed from the frame assembly through an opening of an upper piece of the frame assembly. The outer edges of the window housing, and the grooves of the frame assembly side pieces, may be wedge shaped to ease the removal of the window housing from the frame assembly. The wedge shape also serves to improve contact between the housing and the frame assembly when the housing and window are installed in the frame assembly. The lower piece of the frame assembly has a troth formed at an angle that allows fluid to flow toward the inside of the etching chamber, and weep holes that also allow fluid to drain into the etching chamber.

The window housing may also include a portion that protrudes over its outer edges, with a bottom sealing surface formed to fit against the upper piece of the frame assembly. A rubber seal may be included between the frame assembly and the outer edges of the window housing.

A recess may also be formed to accommodate two clamps on the upper surface of the housing. The window housing is slidably removable, with gravitational force holding the window housing in the frame assembly. The clamps fit in the upper recess and thus prevents the window housing from any upward motion.

The window, window housing, and grooves in said frame assembly may be formed from material resistant to acid corrosion or decay, such as polypropylene, polyvinylchloride, and copolyvinylchloride.

DESCRIPTION OF THE PREFERRED EMBODIMENT

Figure 1:
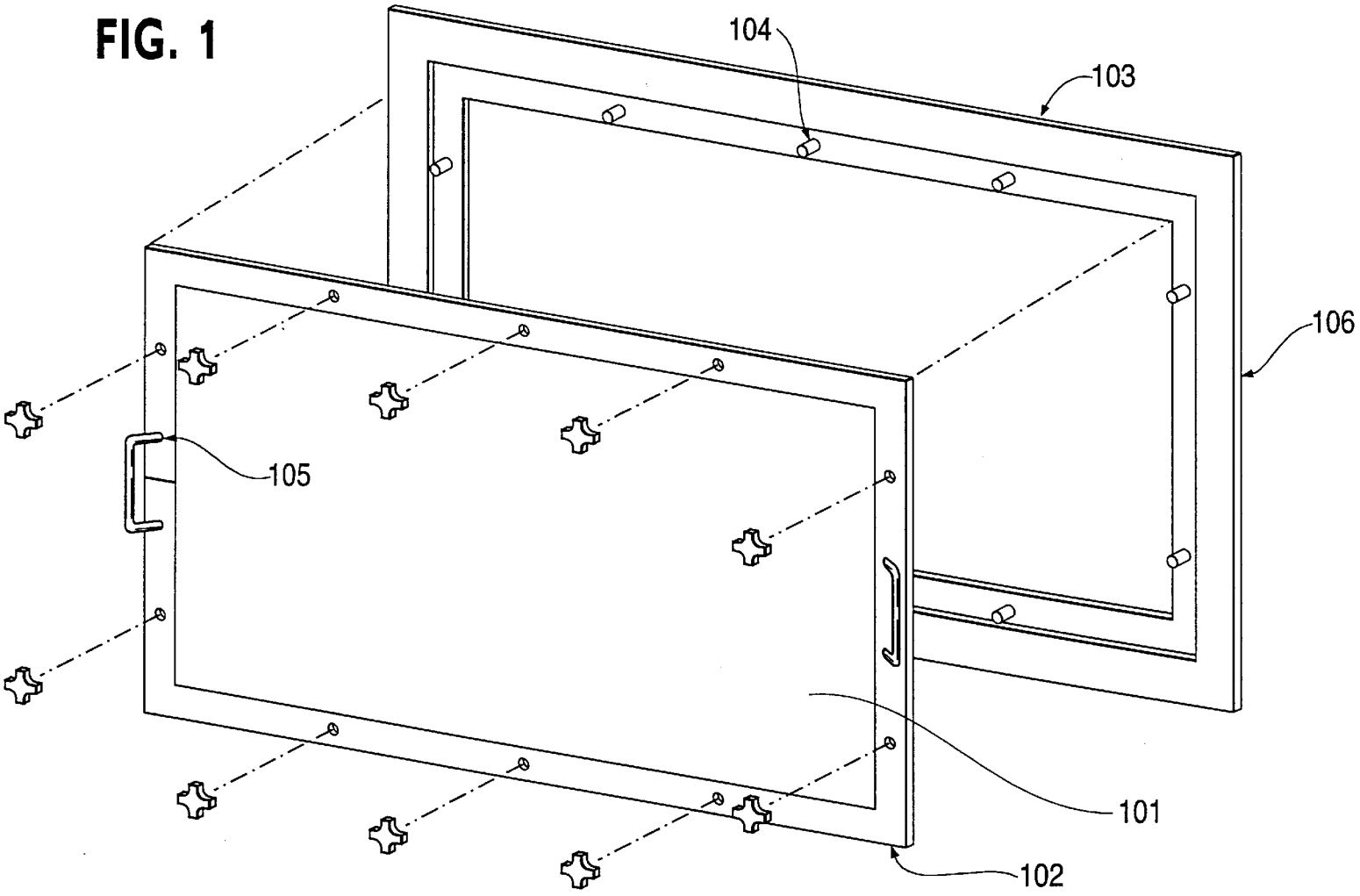
FIG. 1 shows a front view of a typical chemical etching chamber window apparatus according to the prior art, with the window in place against a frame.
Figure 2:
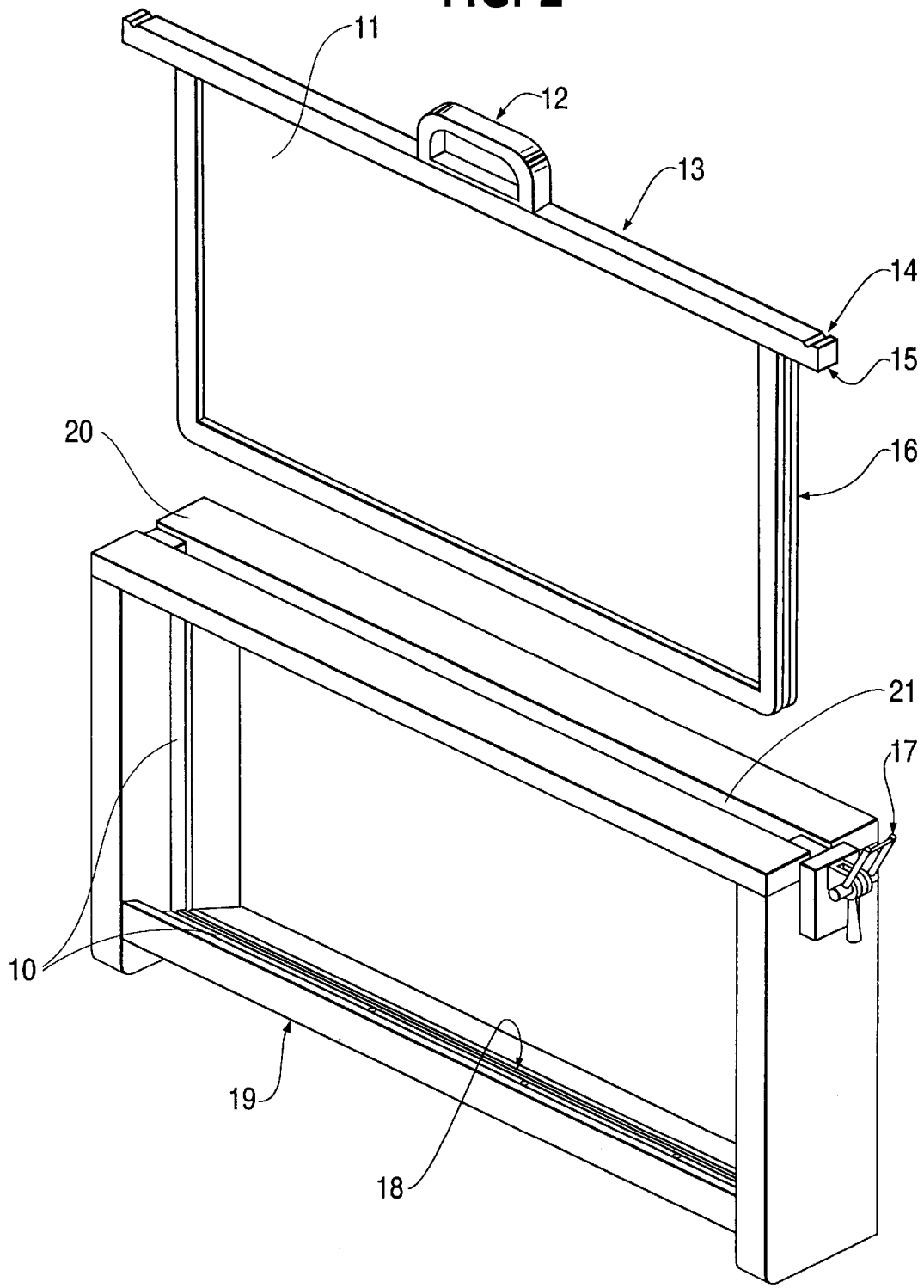
FIG. 2 shows a front view of the present invention with the window and window housing separated from the frame assembly.
Figure 3:
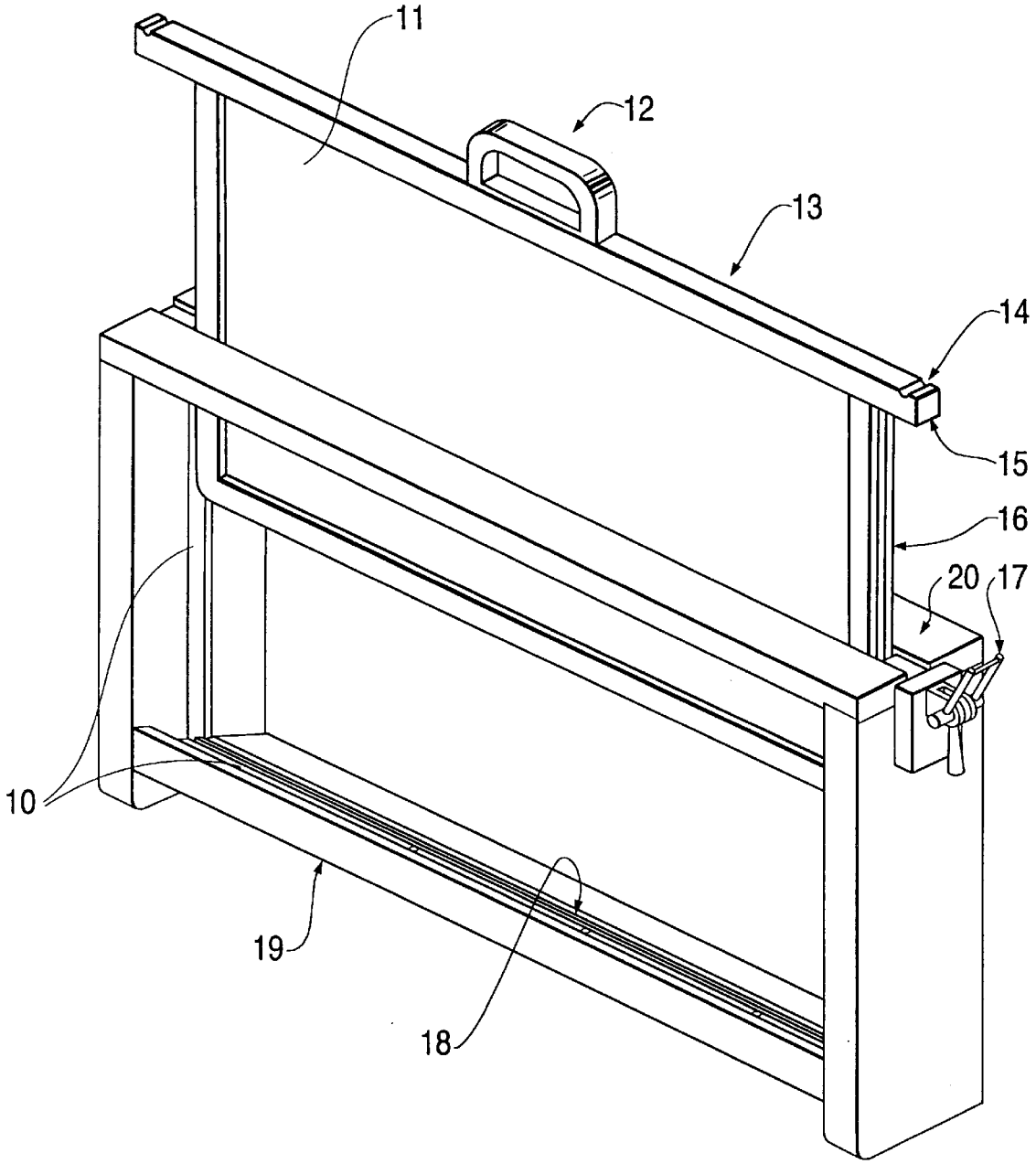
FIG. 3 shows a front view of the present invention with the window and window housing partially installed within the frame assembly.
Figure 4:
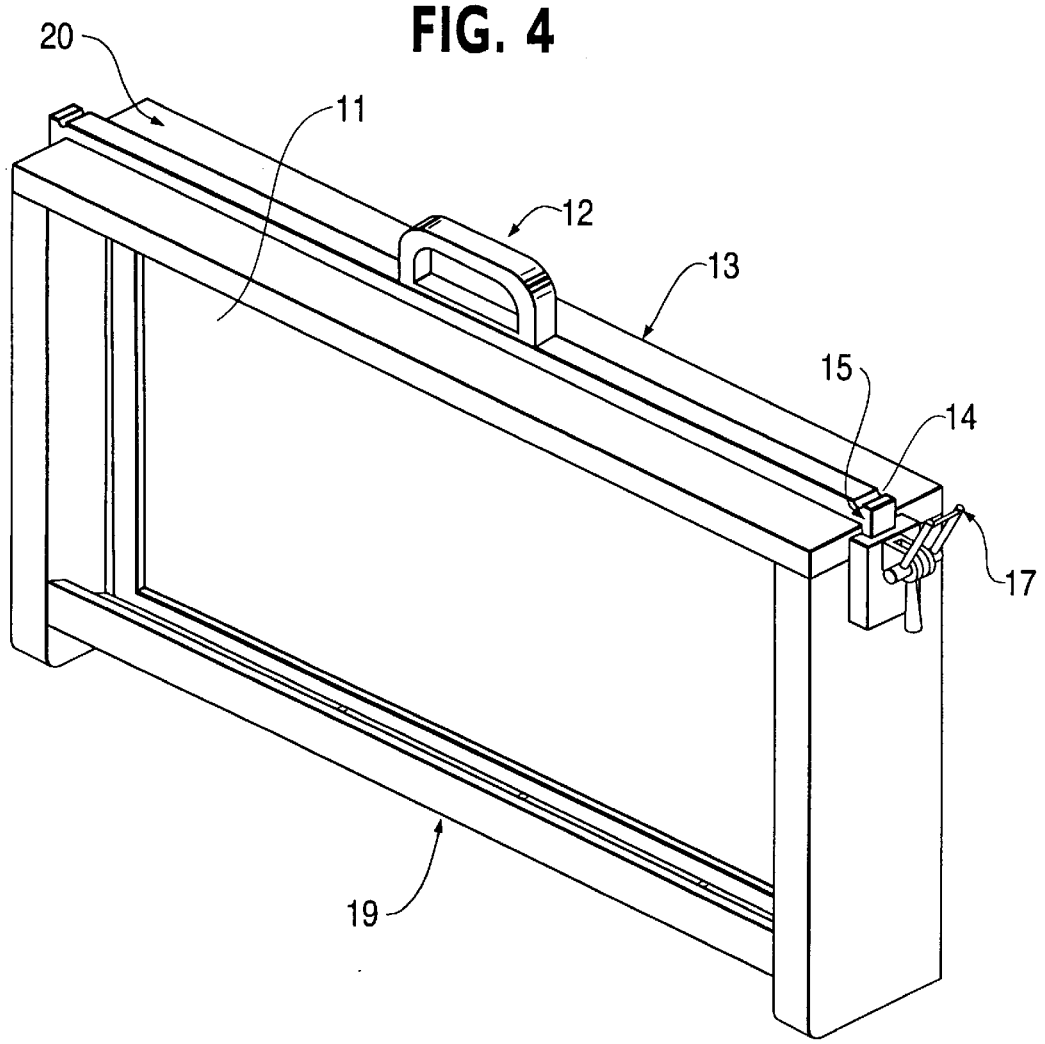
FIG. 4 shows a front view of the present invention with the window and window housing resting within the frame assembly and held in place by gravitational force.

The above described needs are met by the chemical etching chamber window apparatus shown in FIGS. 2 to 4. FIG. 2 shows a window 11 in a window housing 13. It is through the window 11 that spraying activity within a chemical chamber can be viewed. The material must therefore be both transparent and resistant to corrosion or other reaction with the chemicals used in the chamber. In a preferred embodiment the window 11 is made of a plastic material. In a most preferred embodiment the window 11 is made of blue tint transparent polyvinyl chloride (PVC). However, depending on the chemicals to be sprayed and contacted with the window in the chamber, another material may be used that satisfies the needs and objectives of the window. The window housing 13 is bonded with a strong glue to the edges of the window 11. The window housing 13 must also be made of a material that will not react with chemicals sprayed in the chamber. Co-polyvinly chloride (CVPC) or PVC are used as housing material in a preferred embodiment of the invention. A handle 12 is attached to the top of the housing 13. The handle 12 may be made of one of a variety of materials. PVC and CPVC are relatively inexpensive materials that can be used for manufacture of the handle 12. The handle 12 is placed on the top of the housing 13 to ease in removal of the housing 13 from the frame assembly 20.

The frame assembly 20 has grooves 10 that run along inner side pieces and on an inner lower piece. The frame assembly 20 and grooves 10 are formed from polypropylene in a preferred embodiment of the invention. The grooves 10 surround and secure the side and lower edges of the window housing 13. An O-ring can be placed in the grooves 10 to aid in sealing the edges of the window housing 13 to the frame assembly 20. Alternatively, the side and lower edges of the window housing can have grooves 16 which contain an O-ring inserted in the grooves for the same purpose. The O-ring should be made of a flexible chemical resistant material to enable easy installation, removal, and replacement. The O-ring material should also allow use for a long period of time without decay. The O-ring is made of a rubber material such as ethylene-propylene-diene monomer (EPDM) in a preferred embodiment of the invention, but other materials that are more resistant to specific chemicals used in the chamber may at times be preferred.

The window housing 13 enters into the frame assembly 20 through an opening 21 of an upper piece of the frame assembly 20 when in use. The opening 21 and sides of the frame assembly 20 are of a width that allows for a snug fit between the sides of the frame assembly 20 and the window housing 13. The opening 21 also has a depth sufficient to provide a snug fit between the opening 21 and the top edge of the housing 13. An O-ring or polymer foam strip of suitable material may be used to further seal the opening 21 with the top edge of the housing 13. The top edge of the housing 13 has an overhanging portion 15. The overhanging portion 15 provides for further sealing contact with the opening 21. The O-ring or polymer foam strip may be formed along the top edge of the window housing 13, including the side and lower surfaces of the overhanging portion 15. The O-ring or polymer foam strip may alternatively be formed along the opening 21 of the frame assembly 20.

The top edge of the window housing 13 may be slightly wider than the bottom edge of the widow housing, forming a overall wedge shape for the window housing 13. The side grooved portions of the frame assembly 13 also slightly converge to match the width of every part of the window housing 20. The wedge shape allows for ease in removing the window housing 13 from the frame assembly 20. Chemical buildup and thermal expansion tend to make the window housing 13 otherwise difficult to remove from the frame assembly 20. More importantly, the wedge shape serves to improve contact between the housing and the frame assembly when the housing and window are installed in the frame assembly. The frame assembly 20 also has two clamps 17 for further securing the window housing within the frame assembly. The clamps 17 fit in a recessed portion 14 of the window housing 13. The downward force of the clamp, coupled with the wedge shape of the side grooves and the side edges of the window housing increase the contact between the window housing and the frame assembly. Without the unique wedge shape of the side grooves and the side edges of the window housing, the clamp would only increase the contact between the lower edge of the window housing and the lower piece of the frame assembly.

The lower piece of the frame assembly 13 has a troth 19 formed at an angle. The angle in a preferred embodiment of the invention is approximately 20 to 30 degrees to the horizontal, with the lower end of the troth 19 allowing fluid to flow toward the inside of the etching chamber. Assuming that some leakage may eventually occur, the troth 19 is provided as a safety measure to prevent leakage from running to the outside of the etching chamber. To further provide safety from leakage, weep holes 18 are provided in the troth 19. The weep holes 18 draw all fluids away from the apparatus, and the fluids drain into the etching chamber.

Having described an embodiment of the invention, it is to be understood that the invention is not limited to any of the precise embodiments described herein. Various changes and modifications could be effected by one skilled in the art without departing from the spirit or scope of the invention as defined in the appended claims.

What is claimed is:

1. A chemical etching chamber window apparatus, comprising:

a window;

a frame assembly, comprising an opening in an upper piece; and a window housing, having multiple surfaces that are snugly held in and against the frame assembly by a gravitational force, wherein the opening allows for downward and upward entry and removal of the window housing; and a compressor that works in the same direction as the gravitational force to further the contact of the multiple surfaces of the window housing and the frame assembly.

2. A chemical etching chamber window apparatus as set forth in claim 1, further comprising:

a sealer, provided between the multiple surfaces of the window housing and the frame assembly.

3. A chemical etching chamber window apparatus as set forth in claim 1, wherein two of the multiple surfaces of the window housing are not parallel, and wherein the frame assembly is formed to fit against the two non parallel surfaces using the gravitational force.

4. A chemical etching chamber window apparatus as set forth in claim 1, further comprising a receiver for the compressor.

5. A chemical etching chamber window apparatus as set forth in claim 1, further comprising a sealing surface on the window housing that hangs over the upper piece of the frame assembly and comprises the receiver for the compressor.

6. A chemical etching chamber window apparatus as set forth in claim 1, further comprising a flow director, for a liquid that comes into contact with the window or window housing, located on a bottom piece of the frame assembly.

7. A chemical etching chamber window apparatus as set forth in claim 6, wherein said flow director causes the liquids to flow by gravitation toward the inside of the chamber, and comprises at least one drain, and a flat surface at an angle to the horizontal.

8. A chemical etching chamber window apparatus, comprising:

a window comprising a transparent material having outer edges;

a window housing, removably harbored in a frame assembly, comprising outer edges, inner edges that are bonded to said window outer edges, and a handle;

wherein said frame assembly comprises an upper piece, a lower piece having a groove, side pieces having grooves, and clamps, said clamps and grooves being provided for securing said window housing within said frame assembly, said upper piece comprising an opening for entry and removal of said window housing, said lower piece comprising a troth formed at an angle that allows fluid to flow toward the inside of said etching chamber, and weep holes that allow fluid to drain into said etching chamber.

9. The chemical etching chamber window apparatus of claim 8, further comprising an overhanging portion of said window housing protruding over the outer edges of the housing, said overhanging portion comprising a sealing surface and a clamp recess, said sealing surface being formed to fit against said upper piece of said frame assembly, said clamp recess being formed to accommodate said clamp.

10. The chemical etching chamber window apparatus of claim 9, further comprising a sealer between said upper, lower and side pieces of said frame assembly, and said outer edges of said window housing.

11. The chemical etching chamber window apparatus of claim 8, wherein said window housing is slidably removable, and wherein gravitational force holds said window housing in said frame assembly.

12. The chemical etching chamber window apparatus of claim 8, wherein said clamps prevent said window housing from upward motion.

13. The chemical etching chamber window apparatus of claim 8 wherein said window, window housing, and grooves in said frame assembly are formed from material resistant to acid corrosion or decay.

14. The chemical etching chamber window apparatus of claim 13, wherein said material is selected from a group comprising polypropylene, polyvinylchloride, and copolyvinylchloride.

15. The chemical etching chamber window apparatus of claim 8, wherein the outer edges of said window housing form a wedge shape, and the grooves of said frame assembly side pieces, are shaped to accommodate the wedge shape of the outer edges.

* * * * *